US007603066B2

(12) United States Patent
Izumi et al.

(10) Patent No.: US 7,603,066 B2
(45) Date of Patent: Oct. 13, 2009

(54) DEVELOPING DEVICE AND IMAGE FORMING DEVICE AND PREVENTING TONER CONTAMINATION THEREOF

(75) Inventors: Koji Izumi, Osaka (JP); Chisato Hatakeyama, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 576 days.

(21) Appl. No.: 11/427,782

(22) Filed: Jun. 29, 2006

(65) Prior Publication Data

US 2007/0003326 A1 Jan. 4, 2007

(30) Foreign Application Priority Data

Jun. 30, 2005 (JP) ..... 2005-191795

(51) Int. Cl.
*G03G 15/09* (2006.01)

(52) U.S. Cl. ..... 399/272

(58) Field of Classification Search ..... 399/119, 399/272, 276, 277

See application file for complete search history.

(56) References Cited

U.S. PATENT DOCUMENTS

2005/0260015 A1* 11/2005 Ito ..... 399/316

FOREIGN PATENT DOCUMENTS

JP 02226272 A * 9/1990
JP 5-346731 A 12/1993
JP 06083172 A * 3/1994

OTHER PUBLICATIONS

English Translation of JP02226272.*

* cited by examiner

*Primary Examiner*—David M Gray
*Assistant Examiner*—Billy J Lactaoen
(74) *Attorney, Agent, or Firm*—Global IP Counselors, LLP

(57) ABSTRACT

A developing device including a first developing roller and a roller drive mechanism is disclosed. The first developing roller comprises a tubular sleeve, on the surface of which developer is supplied, and a magnetic roller that comprises a drawing magnetic pole for drawing developer and a peel-off magnetic pole for peeling off developer, both of which are arranged on the inner circumference of the sleeve. The drawing magnetic pole is arranged to be adjacent to and upstream of the peel-off magnetic pole in the first rotational direction, in which the magnetic roller rotates during an image forming operation. The roller drive mechanism rotates the magnetic roller in the first rotational direction during the image forming operation, and can rotate the magnetic roller in a second rotational direction that is opposite the first rotational direction.

6 Claims, 3 Drawing Sheets

DEVELOPING DEVICE AND IMAGE FORMING DEVICE AND PREVENTING TONER CONTAMINATION THEREOF

CROSS-REFERENCE TO RELATED APPLICATIONS

This application claims priority to Japanese Patent Application No. 2005-191795. The entire disclosure of Japanese Patent Application No. 2005-191795 is hereby incorporated herein by reference.

BACKGROUND OF THE INVENTION

1. Field of the Invention

The present invention relates to a developing device, and in particular, a developing device for providing toner to a photosensitive drum in an image forming device. In addition, the present invention relates to an image forming device including the same.

2. Background of the Invention

An electrophotographic image forming device such as a laser printer comprises a photosensitive drum on which a toner image is formed, and a developing device for providing the photosensitive drum with toner. The developing device comprises a developing roller that is disposed near the photosensitive drum.

These types of conventional image forming devices includes those which comprise a developing device that is mounted to the main body thereof, and is attachable to and detachable from the main body thereof. In general, with this type of image forming device, a main body thereof and a developing device are separately packaged and shipped. However, the developing device is normally filled with developer, and the surface of the developing roller is normally in a state that developer is easily attached thereto. Therefore, after the developing device is unpacked, the task of removing developer attached to the surface of the developing roller is performed with a predetermined jig.

However, by having a developing device separately packaged from the main body of an image forming device, the number of manufacturing processes will be increased. In addition, it will require a long time to unpack the developing device and fill the developing device with developer when the image forming device is being set up. Furthermore, there is a possibility that mistakes will be made due to the complexity of the setup operation.

Therefore, the following method may be used for a relatively small image forming device, such as a printer-only image forming device, in order to avoid the task of separately packaging the main body and the developing device thereof. That is, the image forming device is shipped in a state in which a developing device filled with developer is mounted on the main body thereof in advance, and the task of removing developer attached to the developing roller is performed by tilting the image forming device when it is being set up.

Technology related to this is disclosed in, for example, Japan Patent Application Publication JP-05-346731.

However, if a developing device is mounted on the main body of the image forming device, there is a possibility that developer attached to the surface of the developing roller will scatter outside the developing device, and thus the interior of the image forming device will become contaminated.

In view of the above, it will be apparent to those skilled in the art from this disclosure that there exists a need for an improved developing device and an image forming device including the same, in which developer can be inhibited from scattering from a developing device when the developing device is mounted on the main body of the image forming device, and thereby avoid contamination of the interior of the image forming device.

SUMMARY OF THE INVENTION

According to a first aspect of the present invention, a developing device is configured to supply developer to a photosensitive drum in an image forming device, and comprises a first developing roller and a roller drive mechanism. The first developing roller comprises a tubular sleeve, on the surface of which the developer is supplied, and a magnetic roller that is arranged in the inner circumferential side of the sleeve. Here, the magnetic roller comprises a drawing magnetic pole for drawing the developer and a peel-off magnetic pole for peeling off the developer. In addition, the drawing magnetic pole is arranged so as to be adjacent to and upstream of the peel-off magnetic pole in a first rotational direction. The roller drive mechanism can rotate the magnetic roller in the first direction during the image forming operation, and can rotate the magnetic roller in a second direction that is opposite the first direction.

In a normal image forming operation, the first developing roller in this device is rotated and driven in the first rotational direction by the roller drive mechanism, and the drawing of the developer is performed by the drawing magnetic pole and the peeling-off of the developer is performed by the peel-off magnetic pole. On the other hand, if the first developing roller is rotated and driven in the second rotational direction, the peel-off magnetic pole will be positioned upstream of the drawing magnetic pole, contrary to the rotation of the developing roller in the first direction. Thus, the drawing of the developer is not performed by the drawing magnetic pole.

Therefore, the developer attached to the surface of the first developing roller can be peeled off by rotating and driving the first developing roller in the second direction, and developer can be reliably recovered in the interior of the developing device. Accordingly, this can prevent the interior of the image forming device from being contaminated with developer.

In addition, an image forming device can be shipped in a state in which the developing device is mounted therein. Therefore, it is not necessary to separately package a developing device from the main body of the image forming device. Accordingly, the number of manufacturing processes of the image forming device can be reduced. In addition, the number of hours required to setup the image forming device can be shortened. Moreover, operational errors can be prevented.

According to a second aspect of the present invention, in the developing device in accordance with the first aspect of the present invention, the developer includes toner and carrier. In addition, the developing device further comprises a second developing roller that is arranged between the first developing roller and the photosensitive drum, and can provide the photosensitive drum with toner.

In particular, this developing device is configured so that the removal of developer from the first developing roller can be reliably performed in a device for which two-component developer can be used (sometimes referred to as a hybrid device).

According to a third aspect of the present invention, the developing device in accordance with the second aspect of the present invention further comprises a roller contact/retraction mechanism that is configured to move the second developing roller to a proximate position to or a retracted position from the photosensitive drum.

According to a fourth aspect of the present invention, in the developing device in accordance with the first aspect of the present invention, the roller drive mechanism drives the first developing roller in the second direction at a speed slower than the speed at which the roller drive mechanism drives the first developing roller in the first direction.

According to this developing device, if the first developing roller is driven to rotate in the second rotational direction, the first developing roller is rotated at a speed slower than the speed at which the first developing roller is rotated during a normal image forming operation. Accordingly, developer is inhibited from scattering from the surface of the roller.

According to a fifth aspect of the present invention, in the developing device in accordance with the first aspect of the present invention, the roller drive mechanism rotates the first developing roller for a predetermined period of time when the first developing roller is rotated in the second rotational direction.

This developing device is configured so that the first developing roller is rotated for a predetermined period of time needed to peel off the developer attached to the surface of the first developing roller, for the purpose of inhibiting developer from scattering.

According to a sixth aspect of the present invention, an image forming device comprises a photosensitive drum and a developing device. The developing device is configured to supply developer to the photosensitive drum. The developing device is the same as the developing device described in the first aspect of the present invention.

According to a seventh aspect of the present invention, the image forming device in accordance with the sixth aspect of the present invention is a tandem color printer, and further comprises a transfer belt on which an image formed on the surface of the photosensitive drum is transferred. In addition, the developing device and the photosensitive drum are arranged below the transfer belt.

In particular, a color printer with this configuration is suitable for peeling off developer from the first developing roller by rotating the first developing roller in the second rotational direction. Therefore, the developer that is peeled off can be easily recovered in the interior of the developing device.

According to the present invention, if the first developing roller is rotated in the second rotational direction, the peel-off magnetic pole will be positioned upstream of the drawing magnetic pole, contrary to the rotation of the first developing roller in the first rotational direction. Therefore, the drawing of the developer will not be performed by the drawing magnetic pole. Therefore, it is possible to peel off developer attached to the surface of the first developing roller by rotating the first developing roller in the second rotational direction. Moreover, developer is prevented from leaking from the developing device, and contamination of the interior of the image forming device can be avoided.

In addition, according to the present invention, an image forming device can be shipped in a state in which the developing device is mounted therein. Therefore, it is not necessary to separately package the developing device from the main body of the image forming device, while this is necessary for a conventional image forming device. Therefore, the number of manufacturing processes of the image forming device can be reduced. In addition, the number of hours required to setup the image forming device can be shortened. Moreover, operational errors can be prevented.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Color Printer

Figure 1:
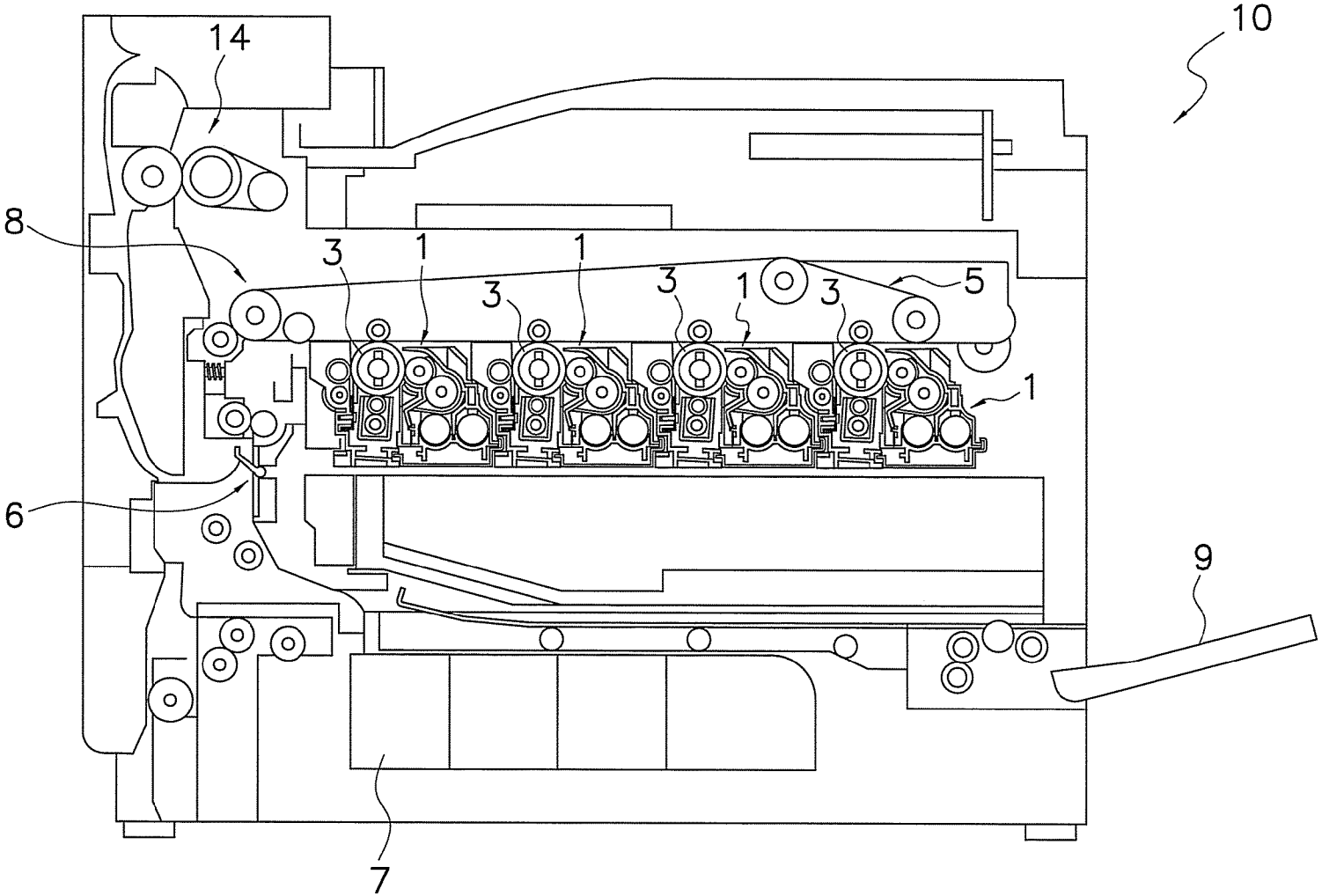
FIG. 1 is a diagram showing a printer to which one embodiment of the present invention is applied.
Figure 2:
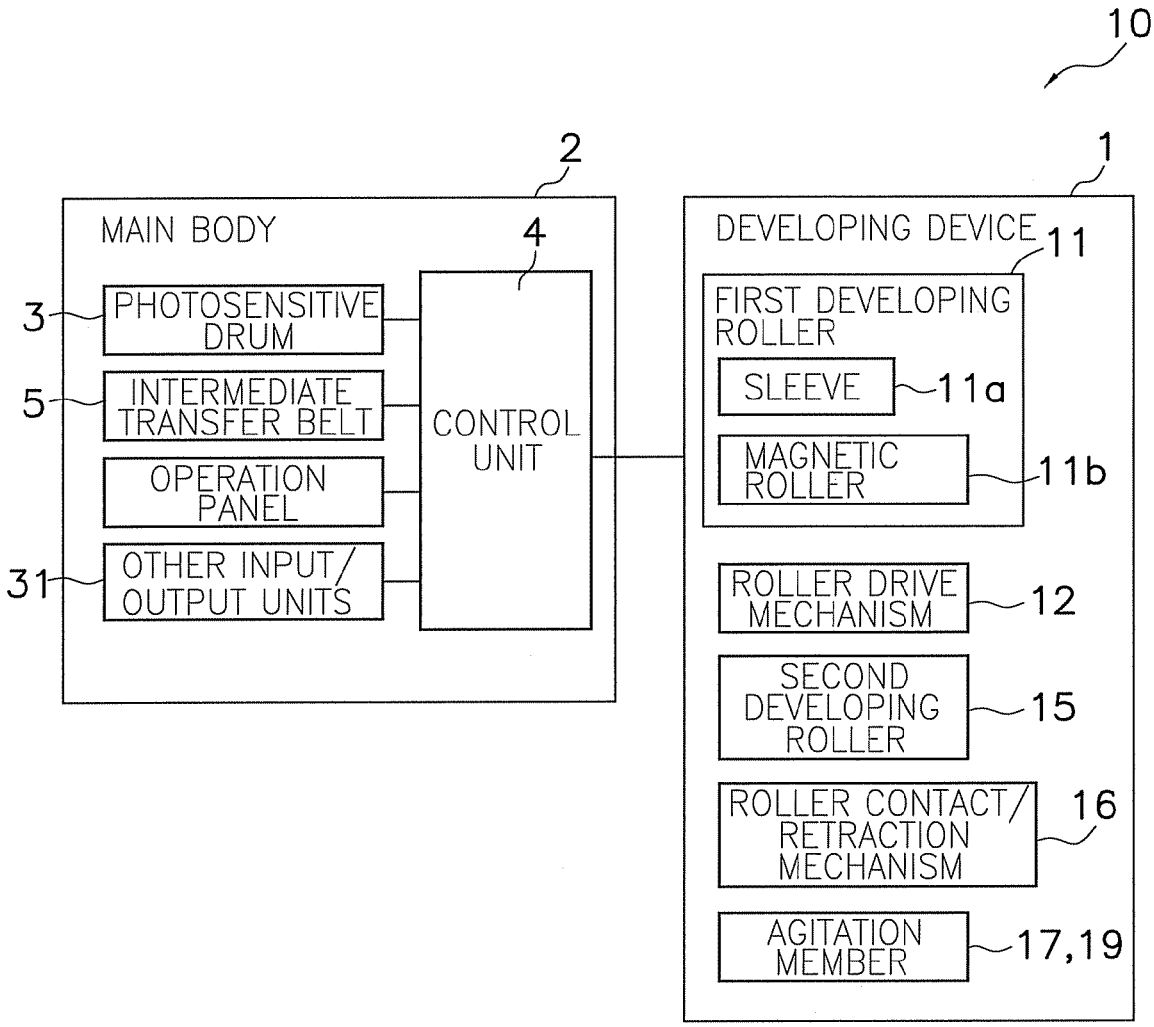
FIG. 2 is a block diagram showing the configuration of the printer.

FIGS. 1 and 2 show the configuration of a tandem color printer 10, which comprises a developing device 1 to which one embodiment of the present invention is applied.

A printer 10 is comprised of a main body 2 and the developing device 1 that is mounted on the main body 2. The main body 2 is configured so that the developing device 1 mounted thereon is detachable and re-attachable thereto. Here, the main body 2 is configured so that the developing device 1 can be disposed in a predetermined position that is in proximity to a photosensitive drum 3 by moving it back and forth in an axial direction.

The main body 2 comprises four photosensitive drums 3, each of which corresponds to each of the four color toners (i.e., cyan, magenta, yellow, and black), an intermediate transfer belt 5, a control unit 4, an operation panel 31, and other input/output units.

Each of the photosensitive drums 3 serves to bear a toner image with each color on the surface thereof and transfer the toner image to the intermediate transfer belt 5. Each of the photosensitive drums 3 and the developing device 1 are disposed below the intermediate transfer belt 5.

The intermediate transfer belt 5 is a continuous belt that is arranged in the interior of the main body 2, extending in the horizontal direction. The intermediate transfer belt 5 is driven to circulate in accordance with an image forming operation. A transfer device 8 transfers the toner image that is transferred to the intermediate transfer belt 5 onto a sheet of paper (or other recording media) that is transported through a paper transport path 6 from a paper supply cassette 7 or a bypass tray 9.

The control unit 4 is comprised of a micro computer including a central processing unit (CPU) and a memory (not shown in the figure). A variety of control programs executed in CPU is stored in the memory. These control programs include a program for performing a toner recovery operation, which is described more in detail later. After this program is executed, if a second developing roller 15 is retracted by a roller contact/retraction mechanism 16 (described below), the control unit 4 will instruct a roller drive mechanism 12 (described below) to drive a first developing roller 11 to rotate for a given period of time, and accordingly the first developing roller 11 will rotate several times (e.g., five times).

The control panel 31 comprises a plurality of operation keys (not shown in the figure). The plurality of operation keys includes a recovery command button for requesting the recovery of developer from the first developing roller 11.

The main body 2 further comprises a transfer device 8, a fixing device 14, a paper supply mechanism (not shown in the figure), and a paper discharge mechanism (not shown in the figure), as the other input/output units.

Developing Device

Figure 3:
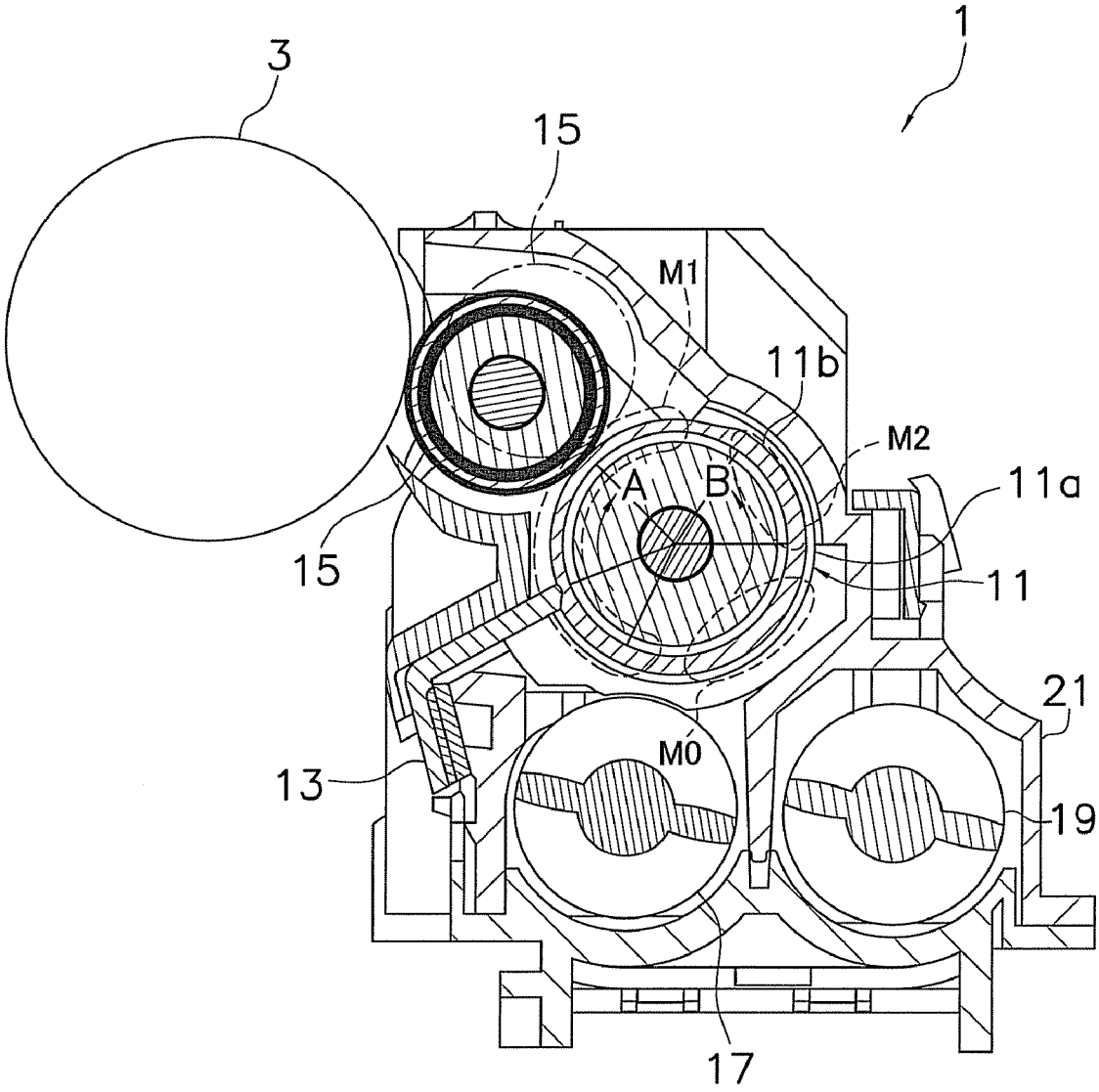
FIG. 3 is a vertical cross-section of a developing device that is mounted in the main body of the printer, and arranged near a photosensitive drum.

FIG. 3 shows the developing device 1.

Only one of the four developing devices 1 will be hereinafter explained. However, four developing devices 1 are configured to be the same, except in that toner colors to be used in the four developing devices 1 are different from each other.

The developing device 1 serves to provide the photosensitive drum 3 in the printer 10 with toner. The developing device 1 comprises the first developing roller 11, the roller drive mechanism 12, a blade 13, a second developing roller 15, the roller contact/retraction mechanism 16, two agitation members 17 and 19, and a casing 21 in which these devices and members are arranged.

The developing roller 11 comprises a tubular sleeve 11*a*, on the surface of which developer can be provided, and a magnetic roller 11*b* that is arranged in the inner circumference side of the sleeve 11*a*. In addition, the first developing roller 11 comprises a drawing magnetic pole M1, a peel-off magnetic pole M2, and a non-magnetic area M0. They are respectively disposed in a predetermined position in the circumferential direction thereof, and are respectively expressed as a circumferential area surrounded by a broken line shown in FIG. 3. The drawing magnetic pole M1 serves to draw developer to the surface of the roller. The peel-off magnetic pole M2 serves to peel off developer from the surface of the roller. The drawing magnetic pole M1, the peel-off magnetic pole M2, and the non-magnetic pole M0 are adjacently disposed in this order in a first rotational direction.

The roller drive mechanism 12 serves to rotate and drive the first developing roller 11. The roller drive mechanism 12 is comprised of a device such as a motor. The roller drive mechanism 12 rotates the first developing roller 11 in the first rotational direction (i.e., in the direction of arrow A shown in FIG. 3) under the control of the control unit 4 when an image forming operation is being executed. In addition, if the recovery command button on the operation panel 31 is pushed, the roller drive mechanism 12 can also rotate the first developing roller 11 in a second rotational direction (i.e., in the direction of arrow B shown in FIG. 3) under the control of the control unit 4 in a developer recovery operation.

The developer recovery operation is performed when the second developing roller 15 is retracted from the photosensitive drum 3 by the roller contact/retraction mechanism 16. Here, the roller drive mechanism 12 rotates the first developing roller 11 at a slower speed, compared to a situation when the roller drive mechanism 12 rotates the first developing roller 11 in the first rotational direction during an image forming operation. In addition, the developer recovery operation is performed only in a given period of time, and the first developing roller 11 will only rotate several times.

The blades 13 serve to control the thickness of developer drawn to the first developing roller 11. The blades 13 are disposed at two positions opposing both ends of the first developing roller 11 in the axial direction.

The second developing roller 15 is arranged in proximity to the first developing roller 11, and can be arranged in proximity to the photosensitive drum 3 in the interior of the printer 10. The second developing roller 15 can be moved to a proximate position to or a retracted position from the photosensitive drum 3 by the roller contact/retraction mechanism 16. The second developing roller 15 in the proximate position to the photosensitive drum 3 is shown in a solid line in FIG. 3. On the other hand, the second developing roller 15 in the retracted position from the photosensitive drum 3 is shown in a dashed line in FIG. 3. The second developing roller 15 is rotated and driven when an image forming operation is being executed. The second developing roller 15 can draw toner from the developer on the first developing roller 11. Note that developer includes toner and carrier.

Gap rollers (not shown in the figure) are mounted on both ends of the second developing roller 15 in the axial direction. In addition, an urging mechanism (not shown in the figure) that applies an urging force towards the photosensitive drum 3 side is mounted on the second developing roller 15. Because of this, if the developing device 1 is mounted on the main body 2 of the printer 10, the gap rolls are in contact with both ends of the photosensitive drum 3 in the axial direction. Thus, the distance between the photosensitive drum 3 and the second developing roller 15 is kept constant.

The roller contact/retraction mechanism 16 comprises a lever member (not shown in the figure) and other members that are operated by the lever member (not shown in the figure). If the lever member is operated when the developing device 1 is attached/detached to/from the main body 2 of the printer 10, the second developing roller 15 will move to the retracted position from the photosensitive drum 3, and thus contact between the photosensitive drum 3 and the second developing roller 15 can be avoided. Furthermore, the second developing roller 15 can be rotated at a predetermined angle in the direction A shown in FIG. 3 (here, approximately 20 degrees) by using the rotation center of the first developing roller 11 as the supporting point for the rotation thereof.

Each of the agitation members 17 and 19 is formed to have the shape of a shaft having a spiral blade formed on the outer circumference thereof, and arranged at the bottom of the casing 21 to be parallel to each other. The agitation members 17 and 19 are rotated and driven with when an image forming operation is being executed. Accordingly, the agitation members 17 and 19 can circulate and transport developer within the casing 21 so as to pass through a partition wall 23 formed in the casing 21.

The interior of the casing 21 is filled with developer.

Operation of Developing Device

Next, an operation of the developing device 1 will be hereinafter explained.

For example, when the printer 10 is manufactured in a factory and then shipped, the entire printer 10 is packaged such that the developing devices 1 are mounted on the main body 2 of the printer 10. Here, the interior of each of the developing devices 1 is filled with developer having the appropriate color. In addition, the developing roller 15 is in the retracted position from the photosensitive drum 3, and controlled by the roller contact/retraction mechanism 16.

Even if the recovery button on the operation panel 31 is pushed when in this state, developer will not be drawn by the drawing magnetic pole M1. This is because the first developing roller 11 rotates in the second rotational direction, and the peel-off magnetic pole M2 is arranged upstream of the drawing magnetic pole M1. Because of this, it is possible to peel off developer attached to the surface of the sleeve 11*a*, and reliably recover developer to the interior of the casing 21. Thus, it is possible to avoid contamination of the interior of the printer 10.

In addition, the printer 10 can be shipped in a state in which the developing devices 1 are mounted on the main body 2 of the printer 10. Therefore, the developing devices 1 are not required to be separately packaged from the main body of the printer 10, while this is required for conventional image forming devices. Accordingly, the number of the manufacturing processes of the printer 10 can be reduced, and the number of hours required for the setup of the printer 10 can be shortened. Furthermore, operational errors can be prevented.

MODIFICATIONS

Modifications will be described below.

(a) The driving time and the rotational speed of the magnetic roller in a developer recovery operation are not limited to the example described in the above embodiment.

(b) The developing device in accordance with the present invention is not limited to a hybrid developing device, but can be applied to a developing device including only one developing roller.

(c) The developing device in accordance with the present invention is not limited to a tandem color printer, and can be applied to a monochrome printer and a single-drum color printer.

(d) An image forming device in which the developing device in accordance with the present invention is mounted is not limited to a printer, and may be an electrophotographic image forming device, such as a multifunction device having other functions such as a copy function and a facsimile function.

GENERAL INTERPRETATION OF TERMS

In understanding the scope of the present invention, the term "configured" as used herein to describe a component, section or part of a device includes hardware and/or software that is constructed and/or programmed to carry out the desired function. In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A developing device configured to supply developer to a photosensitive drum in an image forming device, comprising:

(a) a first developing roller including (i) a tubular sleeve, on the surface of which developer is supplied; and (ii) a magnetic roller being arranged on an inner circumferential side of the sleeve, the magnetic roller having a drawing magnetic pole configured to draw developer and a peel-off magnetic pole configured to peel off developer, the drawing magnetic pole being arranged adjacent to and upstream of the peel-off magnetic pole in a first rotational direction during an image forming operation; and (b) a roller drive mechanism configured to rotate the magnetic roller in the first rotational direction during an image forming operation, and rotate the magnetic roller in a second rotational direction that is opposite the first rotational direction, the roller drive mechanism rotating the first developing roller in the second rotational direction at a speed lower than the speed at which the roller drive mechanism rotates the first developing roller in the first rotational direction.

2. The developing device according to claim 1, wherein the developer includes a toner and a carrier and the developing device further comprises a second developing roller that is arranged between the first developing roller and the photosensitive drum, and configured to supply the photosensitive drum with the toner.

3. The developing device according to claim 2, the developing device further comprises a roller contact/retraction mechanism configured to move the second developing roller proximate to or retracted from the photosensitive drum.

4. The developing device according to claim 1, wherein the roller drive mechanism rotates the first developing roller for a predetermined period of time when the roller drive mechanism rotates the first developing roller in the second rotational direction.

5. An image forming device, comprising:

a photosensitive drum; and a developing device configured to supply developer to the photosensitive drum, the developing device including (a) a first developing roller further including (i) a tubular sleeve, on the surface of which developer is supplied; and (ii) a magnetic roller being arranged in the inner circumferential side of the sleeve, the magnetic roller having a drawing magnetic pole configured to draw developer and a peel-off magnetic pole configured to peel off developer, the drawing magnetic pole being arranged adjacent to and upstream of the peel-off magnetic pole in a first rotational direction during an image forming operation; and (b) a roller drive mechanism configured to rotate the magnetic roller in the first rotational direction during an image forming operation, and rotate the magnetic roller in a second rotational direction that is opposite the first rotational direction, the roller drive mechanism rotating the first developing roller in the second rotational direction at a speed lower than the speed at which the roller drive mechanism rotates the first developing roller in the first rotational direction.

6. The image forming device according to claim 5, wherein the image forming device is a tandem color printer, and further comprises a transfer belt to which an image formed on the surface of the photosensitive drum is transferred; and wherein the developing device and the photosensitive drum are arranged below the transfer belt.

* * * * *